United States Patent [19]

Ewbank et al.

[11] Patent Number: 4,683,722

[45] Date of Patent: Aug. 4, 1987

[54] CHARGING AND EJECTION SYSTEM FOR RANKINE APPARATUS

[75] Inventors: Michael E. Ewbank; Steven Heitz, both of Rockford, Ill.

[73] Assignee: Sundstrand Corporation, Rockford, Ill.

[21] Appl. No.: 864,871

[22] Filed: May 20, 1986

[51] Int. Cl.[4] ..... F01K 13/02

[52] U.S. Cl. ..... 60/656; 60/657

[58] Field of Search ..... 60/656, 657, 646

[56] References Cited

U.S. PATENT DOCUMENTS

| | | | |
|---|---|---|---|
| 664,456 | 12/1900 | Barry et al. | 60/689 |
| 1,622,398 | 3/1927 | Schlatter | 123/69 B |
| 2,278,085 | 3/1942 | Ostermann | 60/670 |
| 2,485,447 | 10/1949 | Keller | 60/657 |
| 3,314,236 | 4/1967 | Zanoni | 60/654 |
| 3,563,035 | 2/1971 | Raymond | 60/657 |
| 3,845,628 | 11/1974 | Bronicki et al. | 60/656 |
| 3,861,151 | 1/1975 | Hosokawa | 60/689 |
| 4,037,414 | 10/1977 | Nicodemus | 60/670 |
| 4,051,680 | 10/1977 | Hall | 60/689 |
| 4,094,147 | 6/1978 | Alleau et al. | 60/656 X |
| 4,121,425 | 10/1978 | Nicodemus | 60/670 |

*Primary Examiner*—Allen M. Ostrager

*Attorney, Agent, or Firm*—Wood, Dalton, Phillips, Mason & Rowe

[57] ABSTRACT

Inefficiencies in charging a closed cycle Rankine apparatus with working fluid and removing non-condensibles from the system are avoided in a Rankine cycle system which includes a source of pressurized fluid 60 and an ejector 64 having a pressure fluid inlet 66, an ejection fluid inlet 68 and an outlet 70, the latter being connected to a reservoir 46 for working fluid. A selectively operable valve 62 interconnects the source 60 and the pressure fluid inlet 66 while the ejection fluid inlet 68 is connected to the remainder of the system. When the valve 62 is operated, the reservoir 46 is pressurized by the pressure fluid as well as non-condensibles in the system entrained therewith withdrawn via the ejection system inlet 68 to charge the system with working fluid.

9 Claims, 1 Drawing Figure

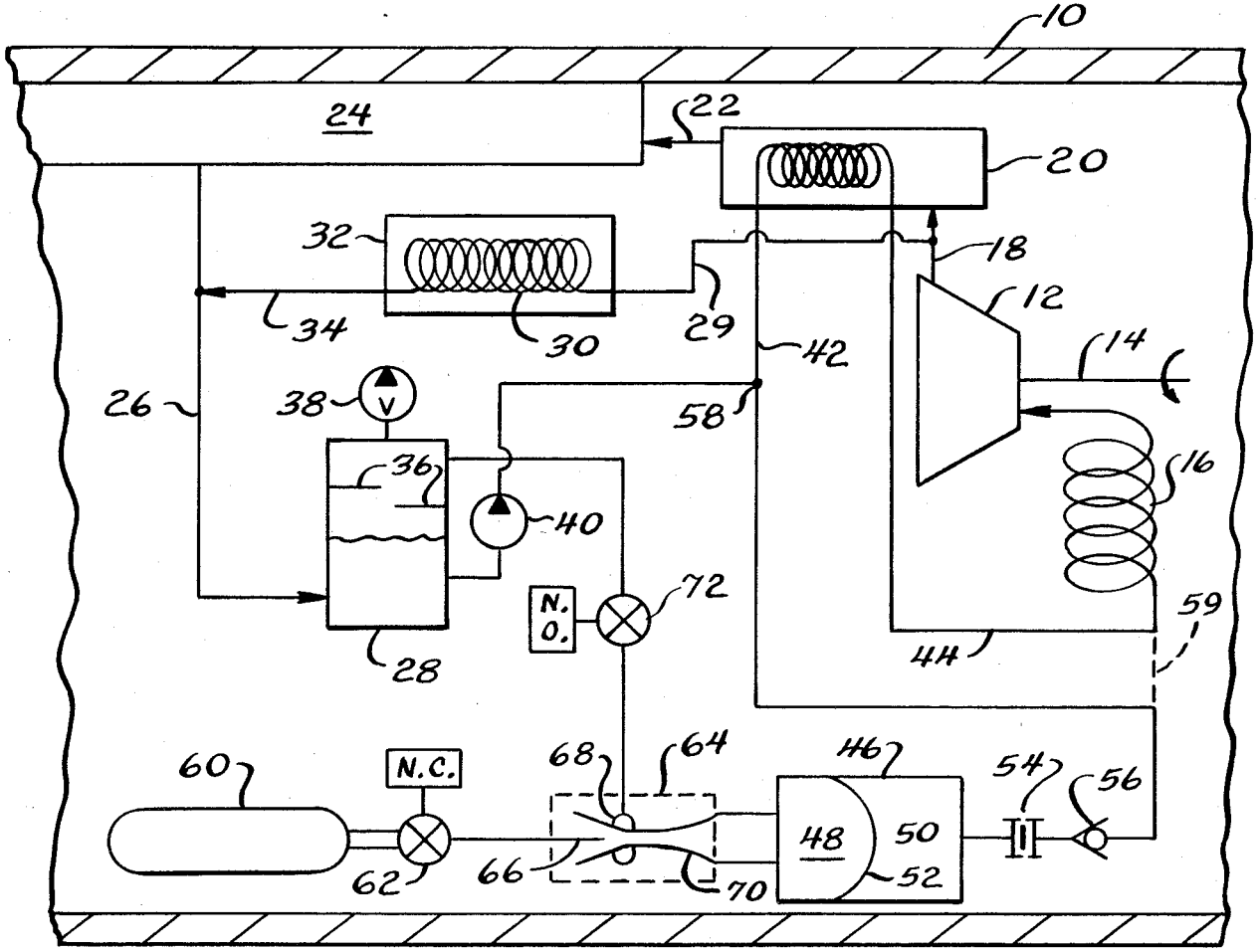
10
20
18
12
14
16
59
56
54
44
50
52
46
48
42
22
29
58
72
64
70
68
66
30
40
N.O.
24
32
34
38
36
28
N.C.
62
60
26

CHARGING AND EJECTION SYSTEM FOR RANKINE APPARATUS

FIELD OF THE INVENTION

This invention relates to a charging and ejector system for a closed cycle Rankine apparatus, and more specifically, to such a system which charges the apparatus with working fluid while ridding the apparatus of non-condensible gases (non-condensibles).

BACKGROUND OF THE INVENTION

Over the years, a variety of stored chemical energy, motion producing systems have been proposed. Frequently, but not always, such systems have been intended for use in providing the propulsion for a naval torpedo. In the usual case, chemical reactants are combined to generate heat which in turn is utilized to generate steam to power a turbine or the like.

Initially, such systems employed open cycle Rankine apparatus including a turbine and which essentially required that spent steam be dumped overboard. When used in a torpedo, a number of disadvantages resulted. For one, the torpedo was relatively noisy as the spent steam was discharged. Secondly, in some instances, the gaseous material being dumped would leave a visible trail highlighting the path that the torpedo was taking.

Thirdly, because the spent steam had to be dumped under water, the pressure against which the steam was being dumped would vary depending upon the running depth of the torpedo. Thus, the rate of propulsion of the torpedo was sensitive to the depth of operation.

In order to avoid these and other difficulties, closed cycle Rankine apparatus or the placing of the power plant in a pressure hull were proposed. Such systems, rather than dumping spent steam from the turbine, condensed the steam and recirculated it to the boiler for re-use or contained it within the pressure hull. As a consequence, noise and gaseous trails associated with steam charge were eliminated. Depth sensitivity was completely avoided.

However, in reverting to closed cycle Ranking apparatus, a new difficulty is encountered. It is the inefficiency in operation of Rankine cycle apparatus associated with the presence of non-condensibles, typically air, in the working fluid flow path of the apparatus. In particular, at the operating temperatures of such apparatus, the much lesser sensible heat of non-condensible gases such as air as compared to steam substantially lowers efficiency.

Where stored energy systems are being utilized in torpedos and employ closed cycle Rankine power plants, evacuation of the system upon manufacture is not practical since the torpedo may be stored for a considerable period prior to use and leakage may occur. Other methods of ridding the system of non-condensibles as may be employed with conventional boiler systems are not satisfactory.

Torpedos optimumly require operation at full power immediately at start-up. Thus, to avoid the inefficiencies associated with the presence of non-condensibles that would prevent utilization of full power at start-up, the non-condensibles must be removed extremely rapidly as part of the start-up sequence.

Moreover, because of the typical storage of torpedoes for a considerable period of time prior to use, it is undesirable to charge the Rankine cycle apparatus with the working fluid at any time prior to start-up. Corrosion can conceivably be a problem over a period of extended storage and leakage of the working fluid from the Rankine cycle apparatus would create inefficiencies. Consequency, it has been typical to store the working fluid in a reservoir until start-up is required. In the usual case, a pressurized gas is applied to the reservoir which then pressurizes the working fluid, typically water, out of the reservoir and into the Rankine cycle apparatus.

While this approach to charging the Rankine cycle apparatus with working fluid has been satisfactory, a fair quantity of gas under pressure must be stored on board the torpedo for ultimate use in charging the Rankine cycle system. The container for such gas is necessarily of substantial strength and consequently is relatively heavy. Desirably, the weight of this container could be reduced.

The present invention is directed to overcoming the previously mentioned difficulties.

SUMMARY OF THE INVENTION

It is the principal object of the invention to provide a new and improved Rankine cycle power plant. More specifically, it is an object to provide a closed cycle Rankine power plant including means for simultaneously charging the system with working fluid while ridding the same of non-condensibles.

An exemplary embodiment of the invention achieves the foregoing object in a Rankine cycle system including a boiler, an engine for receiving condensible working fluid from the boiler, a pressurizable reservoir for working fluid for providing working fluid to the boiler and a condenser for receiving working fluid from the engine and condensing the same. A conduit interconnects the boiler, engine, reservoir and condenser. There is also provided a source of pressurized fluid. An ejector is included and has a pressurized fluid inlet, an ejection fluid inlet connected to the conduit, and an outlet, the outlet being connected to the reservoir.

A selectively operable valve interconnects the pressure fluid source and the pressurized fluid inlet.

Consequently, operation of the valve to interconnect the source and the pressurized fluid inlet will result in pressurized fluid passing through the ejector to draw non-condensibles from the conduit, the condenser, the engine and the boiler, and additionally, provide the reservoir with the pressurized fluid and non-condensibles to elevate the pressure therein to drive the working fluid to the boiler.

The ejector thus removes non-condensibles from the system to maximize operational efficiency and charges the system with the working fluid. In respect to the latter, because the reservoir is pressurized by both the pressure fluid and the non-condensibles, a lesser quantity of pressure fluid is required than would be the case if only pressure fluid were utilized to pressurize the reservoir. As a direct consequence, the size and weight of the storage bottle or the like for the pressurized fluid may be commensurately reduced.

In a preferred embodiment, the condenser is connected to the boiler to return condensed working fluid thereto. There is further provided a control valve in the conduit between the reservoir and the point of connection of the condenser to the boiler which is operable to allow the flow of working fluid from the reservoir to the boiler and prevent the reverse.

In a highly preferred embodiment, such control valve is a check valve.

The invention also contemplates the provision of a selectively operable valve interposed between the ejection fluid outlet and the conduit which may be closed after the ejection portion of the process is completed.

In a highly preferred embodiment, both of the valves are explosively operated valves. The valve between the pressure source and the ejector is normally closed while the valve between the ejection fluid inlet and the conduit is normally open.

The invention further contemplates that the reservoir be an accumulator having first and second, variable volume, fluid isolated chambers separated by a movable element. The working fluid is stored in one of the chambers and the pressure fluid and the non-condensibles are directed to the other of the chambers. As a consequence, the movable element shifts in response to the pressure to drive the working fluid out of the chamber occupied by it.

Other objects and advantages will become apparent from the following specification taken in connection with the accompanying drawings.

DESCRIPTION OF THE DRAWINGS

The FIGURE is a schematic of a Rankine cycle system made according to the invention.

DESCRIPTION OF THE PREFERRED EMBODIMENT

An exemplary embodiment of a Rankine cycle apparatus made according to the invention is illustrated in the FIGURE in the environment of a torpedo, a portion of the pressure hull 10 of which is shown. Within the hull 10 is a turbine wheel 12 having an output shaft 14 connected by any suitable means to a propeller (not shown) for the torpedo.

The turbine wheel 12 is driven by steam received from a boiler 16. The boiler 16 is typically fired by a chemical energy source (not shown) which generates sufficient heat to vaporize the working fluid, typically water, as a consequence of a chemical oxidation reaction.

Spent steam from the turbine 12 is fed via a line 18 to a heat exchanger 20 which acts as a regenerator. Basically, the regenerator 20 removes any remaining superheat from the steam.

An outlet 22 from the regenerator 20 directs the spent steam, now at saturation, to a conventional hull condenser 24 where it is fully condensed and then flowed via conduit 26 to a hot well 28.

In parallel with the line defined by the regenerator 20 and the hull condenser 24 is a system branch including a conduit 29 extending to a heating element 30 within an oxidant reservoir 32. The reservoir 32 is adapted to contain the oxidant utilized in the previously mentioned chemical reaction. In the usual case, the oxidant will be stored in the liquid form within the reservoir 32 and evaporated therein before being fed to a reactor. The evaporation, of course, will cool the liquid oxidant within the reservoir 32. In order to prevent the same from freezing, the heating element 30 is provided. A conduit 34 connects the heating element 30 to the line 26.

The hot well 28 includes internal baffles 36 to prevent liquid from splashing to an upper location connected to a vacuum pump 38. In operation of the system, the vacuum pump 38 will be continuously driven to remove any non-condensibles that enter the system.

A lower outlet from the hot well 28 is connected to a pump 40. The pump 40 pumps condensate from the hot well 28 on a conduit 42 to the regenerator 20 where it is preliminarily warmed by the superheat of the spent steam passing therethrough. From the regenerator 20, the condensate is fed via a conduit 44 to the inlet side of the boiler 16.

As is typical in power plants of this type, the system is not charged with working fluid until its operation is required. Thus, there is provided a reservoir for working fluid in the form of an accumulator 46. The accumulator 46 is divided into two, variable volume chambers 48 and 50 which are separated by a movable element such as a diaphragm 52 or the like. The diaphragm 52 provides fluid isolation between the chambers 48 and 50.

Working fluid for the system is stored in the chamber 50 which has an outlet extending to a so-called burst disk 54 and then to a check valve 56. The check valve 56 is in turn connected to a junction 58 in the line 42 between the pump 40 and the regnerator 20. Alternatively, the check valve 56 could be connected by a line 59 to the junction between the condensate return line 44 and the boiler 16. The choice of the path to be used will normally be dictated by spatial constraints imposed by the location of system components within the hull 10.

When the system is to be started, the burst disk 54 is broken in a conventional fashion and the chamber 48 pressurized. The movable element 52 will then, under the influence of pressure, move to the right as viewed in the FIGURE to reduce the volume of the chamber 50 thereby driving the working fluid out of the chamber 50 past the check valve 56 and into the boiler 16. The check valve 56 prevents back flow. Other forms of valves could be used in lieu of the check valve 56 if desired.

The chamber 48 is pressurized by both pressure fluid and non-condensibles removed from the system. Pressurized fluid such as a relatively inert gas or the like is maintained in a pressure bottle 60. The outlet of the pressure bottle 60 is controlled by a normally closed, explosively operated valve 62. The valve 62 is connected to the pressure fluid inlet of a conventional venturi or jet ejector 64. Such an inlet is shown at 66. Those skilled in the art will recognize that a conventional ejector such as the ejector 64 will also have an ejection fluid inlet such as shown at 68 and an outlet such as shown at 70. The outlet 70 is connected to the chamber 48 while the ejection fluid inlet 68 is connected via a normally open explosively operated valve 72 to the upper end of the hot well 28.

Operation is generally as follows. When it is desired to initiate operation of the system, the valve 62 is fired and now moves to a normally open configuration. Pressure fluid from the source 60 will pass through the ejector 64 into the chamber 48. In so doing, it creates a reduced pressure at the ejection fluid inlet 68. This in turn causes non-condensibles throughout the system to flow to the ejector 64 through the normally open valve 72 to be entrained with the pressure fluid and carried into the chamber 48. The pressurization of the chamber 48 causes the working fluid to be expelled into the system as mentioned previously; and the rate of such expulsion is enhanced by reason of the reduced pressure existing in the system at this point in time by operation of the ejector 64.

When the charging of the system and initial removal of non-condensibles is complete, the valve 72 is fired to change its configuration to closed thereby shutting off the ejector 64 from the system to prevent any backflow once the pressure in the bottle 60 and the chamber 48 reach equilibrium.

During continued operation of the system, the vacuum pump 38 will be operative to remove such non-condensibles as may leak into the system.

A number of advantages result from the foregoing. Because the pressure gas utilized for charging the accumulator 46 is kept within a closed circuit and not released to the interior of the pressure hull to somewhat elevate the pressure therein, the vacuum pump 38 need not work against such elevated pressure. Thus, its size and/or operational energy requirements may be reduced, thereby leaving more energy available for propulsion of the torpedo. Further, the noise generated by the vacuum pump will also be reduced since it operates at a lower pressure ratio.

Non-condensibles are rapidly removed from the system during start-up so that maximum efficiency of operation will virtually be immediately present.

Furthermore, the size of the pressure source, namely the bottle 60, can be reduced over other systems employing pressurized fluid for charging a reservoir in that the reservoir is charged with a volume of gas that is the combined volume of the pressurized gas and the non-condensibles. In other words, the ejector 64 acts as an amplifier to increase the amount of pressurization obtainable within the chamber 48 over that obtainable solely from the pressure bottle 60 by including the non-condensibles.

Finally, working fluid charging is enhanced because of the reduced pressure applied to the system during charging by operation of the ejector 64.

What is claimed is:

1. A Rankine cycle system comprising:

a boiler;

an engine for receiving condensible working fluid from the boiler;

a pressurizable reservoir for working fluid for providing working fluid to the boiler;

a condenser for receiving working fluid from the engine and condensing the same;

a conduit interconnected the boiler, engine, reservoir and condenser;

a source of pressure fluid;

an ejector having a pressure fluid inlet, an ejection fluid inlet connected to said conduit, and an outlet, said outlet being connected to said reservoir; and a selectively operable valve interconnecting said source and said pressure fluid inlet;

whereby operation of said valve to interconnect said source and said pressure fluid inlet will (1) result in pressured fluid passing through said ejector to draw noncondensibles from said conduit, said condenser, said engine and said boiler, and (2) provide said reservoir with said pressure fluid and noncondensibles to elevate the pressure therein to drive the working fluid to the boiler.

2. The system of claim 1 wherein said condenser is connected to said boiler to return condensed working fluid thereto, and further include a control valve in said conduit between said reservoir and the point of connection of said condenser to said boiler and operable to allow the flow of working fluid from the reservoir to the boiler and prevent the reverse.

3. The system of claim 2 wherein said control valve is a check valve.

4. The system of claim 1 further including a further selectively operable valve interposed between said ejection fluid inlet and said conduit.

5. The system of claim 3 wherein both said valves are explosively operated valves and the first-named valve is normally closed and said the second named valve is normally opened.

6. The system of claim 1 wherein said reservoir is an accumulator having first and second, variable volume, fluid isolated chambers separated by a movable element, said working fluid being stored in one of said chambers and said pressure fluid being directed to the other of said chambers.

7. A propulsion system for a torpedo or the like comprising:

a working fluid flow path including a steam turbine and a boiler connected to said turbine for providing steam thereto;

an accumulator having a storage chamber adapted to store water and a pressure chamber, and constructed such that the admission of a pressurized medium to said pressure chamber will expel the contents of said storage chamber;

first means, including a water flow control valve, connecting said storage chamber to said boiler;

a source of fluid under pressure;

second means, including a pressure fluid control valve, connecting said source to said pressure chamber; and means associated with said second means and responsive to the flow of fluid under pressure therethrough for creating an evacuating force in said working fluid flow path;

whereby water will be forcibly urged into said boiler under the influence of pressure in said pressure chamber and drawn into said boiler by the evacuating force of said creating means.

8. A propulsion system for a torpedo or the like comprising a closed working fluid flow path including a turbine, a boiler connected to the turbine, and a condenser interconnecting the turbine and the boiler;

an accumulator having a storage chamber adapted to store water and a pressure chamber, and constructed such that the admission of a pressurized medium to said pressure chamber will expel the contents of said storage chamber;

first means, including a water flow control valve, connecting said storage chamber to said boiler;

a source of fluid under pressure;

second means, including a pressure fluid control valve, connecting said source to said pressure chamber; and a jet ejector having a pressure fluid inlet and an outlet in said second means and a ejection fluid inlet in said flow path whereby water is expelled from said storage chamber by a fluid volume equal to that of both said fluid under pressure and fluid evacuated from said flow path thereby allowing the use of a smaller pressure source than would otherwise be required if only the volume of the fluid under pressure ws directed to said pressure chamber.

9. The propulsion system of claim 8 further including flow control valves for both of the inlets of said jet ejector.

* * * * *